US006511408B2

(12) United States Patent
Miki et al.

(10) Patent No.: US 6,511,408 B2
(45) Date of Patent: Jan. 28, 2003

(54) PAPER FOLDING MECHANISM

(75) Inventors: Wataru Miki, Hyogo (JP); Masafumi Morimoto, Hyogo (JP)

(73) Assignee: Fujitsu Limited, Kawasaki (JP)

( * ) Notice: Subject to any disclaimer, the term of this patent is extended or adjusted under 35 U.S.C. 154(b) by 82 days.

(21) Appl. No.: 09/725,449

(22) Filed: Nov. 30, 2000

(65) Prior Publication Data

US 2002/0052283 A1 May 2, 2002

(30) Foreign Application Priority Data

May 31, 2000 (JP) ..... 2000-162864

(51) Int. Cl.[7] ..... B31F 1/00

(52) U.S. Cl. ..... 493/413; 493/430; 493/433; 493/448; 493/431

(58) Field of Search ..... 493/414, 430, 493/433, 448, 406, 429, 413, 451

(56) References Cited

U.S. PATENT DOCUMENTS 3,514,096 A * 5/1970 Muller ..... 493/410
4,045,012 A * 8/1977 Jakob ..... 493/415
4,054,235 A * 10/1977 Witcher ..... 226/195
4,070,014 A * 1/1978 Takahashi ..... 270/39.09
4,676,113 A * 6/1987 Bond ..... 74/102
4,770,402 A * 9/1988 Couturier ..... 270/39.02
4,846,454 A * 7/1989 Parkander ..... 270/5.02
5,074,837 A * 12/1991 Blanton et al. ..... 493/410
5,104,366 A * 4/1992 Bunch ..... 493/23
5,642,951 A * 7/1997 Belizario ..... 400/613.2
5,730,695 A * 3/1998 Hauchild et al. ..... 270/39.02
6,228,014 B1 * 5/2001 De Matteis et al. ..... 493/424
6,254,522 B1 * 7/2001 Schmidt ..... 493/357

* cited by examiner

*Primary Examiner*—Rinaldi I. Rada
*Assistant Examiner*—Louis Tran
(74) *Attorney, Agent, or Firm*—Armstrong, Westerman & Hattori, LLP

(57) ABSTRACT

A paper folding mechanism for folding continuous paper is provided. The folding mechanism includes a swing guide caused to pivot for guiding the paper, and first and second paper guides which are spaced from each other. The first paper guide is displaceable relative to the second paper guide. The folding mechanism also includes a paper presser arranged adjacent to the first paper guide for folding the paper along fold lines. The paper presser is designed to move relative to the first paper guide.

20 Claims, 13 Drawing Sheets

PAPER FOLDING MECHANISM

BACKGROUND OF THE INVENTION

1. Field of the Invention

The present invention relates to a paper folding mechanism used for e.g. an electrophotographic printer. More specifically, it relates to a paper folding mechanism for alternately folding continuous recording paper to be stacked in a paper stacker disposed at the end of the paper transfer path of a printer.

2. Description of the Related Art

Conventionally, various kinds of paper folding mechanisms have been used for electrophotographic printers. FIG. 12 of the accompanying drawings shows an example of conventional folding mechanisms.

Specifically, the illustrated conventional paper folding mechanism 200 includes a swing guide 1, a plurality of first paper guides 102*a* and a plurality of second paper guides 102*b*. The swing guide 1, supported by a driving shaft 14, is caused to swing between the first and the second paper guides 102*a*, 102*b*. The paper guides 102*a* and 102*b* are fixed, at their upper ends, to a first frame 110*a* and a second frame 110*b*, respectively, to be held in an upright position. The first paper guides 102*a* are spaced from the counterpart second paper guides 102*b* by a distance equal to the "sheet length" (defined below) of continuous paper.

Referring to FIG. 11, a typical example of continuous recording paper is shown, which is equally usable for the conventional folding device and a device of the present invention. The illustrated paper P is formed with a series of indexing holes P1 disposed at regular intervals along each longitudinal edge Pa and Pb. Further, the paper P is provided with a plurality of fold lines (perforation lines) P2 each of which extends across the paper P. These perforation lines P2 are spaced from each other longitudinally of the paper P by a constant pitch or "sheet length" L. The continuous paper P can be readily severed into separate paper sheets due to the perforation lines P2. Different types of continuous paper may have a different width W and/or sheet length L.

The conventional paper folding mechanism 200 further includes a vertically movable stacker table T, a plurality of first rotary blades 103*a* and a plurality of second rotary blades 103*b*. The printed recording paper, after being folded by the first or second blades, is piled on the stacker table T. The first rotary blades 103*a* are attached to a first driving shaft 104*a* and arranged adjacent to the first paper guides 102*a*, while the second rotary blades 103*b* are attached to a second driving shaft 104*b* and arranged adjacent to the second paper guides 103*b*. The first driving shaft 104*a* is rotatably attached to the first frame 110*a*, while the second driving shaft 104*b* is rotatably attached to the second frame 110*b*.

As shown by the two-headed arrow Ar in FIG. 12, the first frame 110*a* is movable toward or away from the second frame 110*b*, whereby the first paper guides 102*a*, which are carried by the fist frame 110*a*, can be moved closer to or farther away from the counterpart second paper guides 102*b*. Such an adjustable guide distance between the first and the second paper guides is advantageous to dealing with various types of continuous paper having different sheet lengths L.

In operation, the swing guide 1 is caused to swing about the axis of the shaft 14. In synchronism with this swing motion, a predetermined length of the paper P will be paid out from the guide 1. Thus, the paid-out portion of the paper P will be warped near the first paper guides 102*a* or second paper guides 102*b* (see FIG. 13). Then, with the paper P being thus warped, the first rotary blades 103*a* or second rotary blades 103*b* will hit upon the warped paper portion, thereby folding the paper P along the perforation line P2. As the volume of the paper P stacked on the stacker table T increases, the table T is lowered, so that the first and the second rotary blades 103*a*, 103*b* can hit the paper P properly for folding the paper.

In the conventional paper folding mechanism, as stated above, the first paper guides 102*a* and the first driving shaft 104*a* are attached to the same movable frame 110*a*. Thus, the positional relation between the guides 102*a* and the shaft 104*a* will remain the same before and after the first frame 110*a* is moved in the directions of arrow Ar. This unchanging positional relation renders the conventional paper folding mechanism disadvantageous in the following points.

For clarifying the problem of the conventional paper folding mechanism, it is now supposed that use is made of continuous paper having a relatively long sheet length L. In this case, as shown in FIG. 13, the distance between the first and the second paper guides 102*a*, 102*b* will be increased in accordance with the sheet length L, to accommodate the folded paper. Also, a relatively great length of paper is paid out from the swing guide 1 for performing one paper-folding operation by the first or second rotary blades.

In such an instance, as shown in FIG. 13, the paid-out paper P tends to be warped with a rather great radius of curvature. As a result, the warped portion of the paper P may fail to come close enough to the rotary blades 103*a*, so that the warped portion will merely be pushed toward the second paper guides 102*b* by the blades 103*a* without being folded at all.

Another example of erroneous paper-folding in the conventional mechanism is shown in FIG. 14. Specifically, being partially folded, the paper P may suffer from a wrinkle N generated at a fold line P2. Such a defect may often be observed when solid printing is performed across the perforation line P2, since the solid printing portion tends to prevent the paper P from being properly folded.

SUMMARY OF THE INVENTION

The present invention has been proposed under the circumstances described above. It is, therefore, an object of the present invention to provide a paper folding mechanism designed to overcome the above conventional problems.

According to the present invention, there is provided a paper folding mechanism for continuous paper provided with fold lines spaced by a constant sheet length. The folding mechanism includes: a swing guide caused to pivot for guiding the paper; a first and a second paper guides spaced from each other by a guide distance corresponding to the sheet length, the first paper guide being displaceable relative to the second paper guide; and a paper presser arranged adjacent to the first paper guide for folding the paper along the fold lines. The paper presser is displaceable relative to the first paper guide.

With such an arrangement, it is possible to move the paper presser closer to or away from the continuous paper to be folded. Thus, by adjusting the position of the paper presser, a warped portion of the paper will be properly hit by the paper presser, which is advantageous to folding the paper properly.

In a preferred embodiment of the present invention, the paper presser may include a presser blade and a rotatable shaft to fix the presser blade. In this case, the shaft is displaceable relative to the first paper guide.

Preferably, the presser blade may include a free end portion and a base end portion fixed to the rotatable shaft, wherein the free end portion is more flexible than the base end portion. With such an arrangement, the paper is effectively prevented from being torn by the presser blade.

Preferably, the paper folding mechanism of the present invention may further include paper presser shifting means for displacing the paper presser relative to the first paper guide in accordance with displacement of the first paper guide. With such an arrangement, the paper presser can be automatically moved relative to the first paper guide. For instance, the paper presser shifting means may cause the paper presser to approach the first paper guide as the guide distance becomes greater.

Preferably, the paper presser shifting means may include a side plate for rotatably fixing the shaft, a lever pivotable relative to the side plate, a guide rail with which the lever is held in slidable contact, and a paper guide supporting member to which the first paper guide is attached. The paper guide supporting member is engaged with the lever and displaceable relative to the side plate.

Preferably, the guide rail may be provided with an inclined edge, and the lever may be provided with a roller urged into contact with the inclined edge of the guide rail.

According to the present invention, the paper folding mechanism may further include presser blade halting means for retaining the presser blade in a home position before the presser blade hits the paper. In the home position, the presser blade may be inclined toward the paper beyond the first paper guide. With such an arrangement, the warping of the paper will be prevented from becoming unacceptably large. Thus, the presser blade can properly fold the paper along the fold lines.

Preferably, the presser blade halting means may include a sensor for detecting a rotational position of the shaft. Further, the presser blade halting means may include a home position detection plate attached to an end of the shaft.

In the above case, the sensor may be provided with a light emitting portion and a light receiving portion spaced from the light emitting portion. When the shaft is rotated, the home position detection plate may be periodically brought into a clearance between the light emitting portion and the light receiving portion when the shaft is rotated. As a result, the light emitted from the light emitting portion is shielded by the detection plate, whereby it is known that the presser blade has been brought to the home position.

According to a preferred embodiment of the present invention, each of the paper guides may be provided with an inclined upper portion and an upright lower portion, wherein the upper portion is inclined to extend along the paper to be folded.

Preferably, the inclined upper portion may be connected to the upright lower portion by a hinged portion permitting adjustment of an angle between the upper portion and the lower portion.

Preferably, the paper folding mechanism of the present invention may further include auxiliary paper folding means attached to the swing guide. The auxiliary paper folding means may be a chain dangling from the swing guide.

Other features and advantages of the present invention will become apparent from the detailed description given below with reference to the accompanying drawings.

DETAILED DESCRIPTION OF THE PREFERRED EMBODIMENTS

The preferred embodiments of the present invention will be described below with reference to the accompanying drawings.

Figure 1:
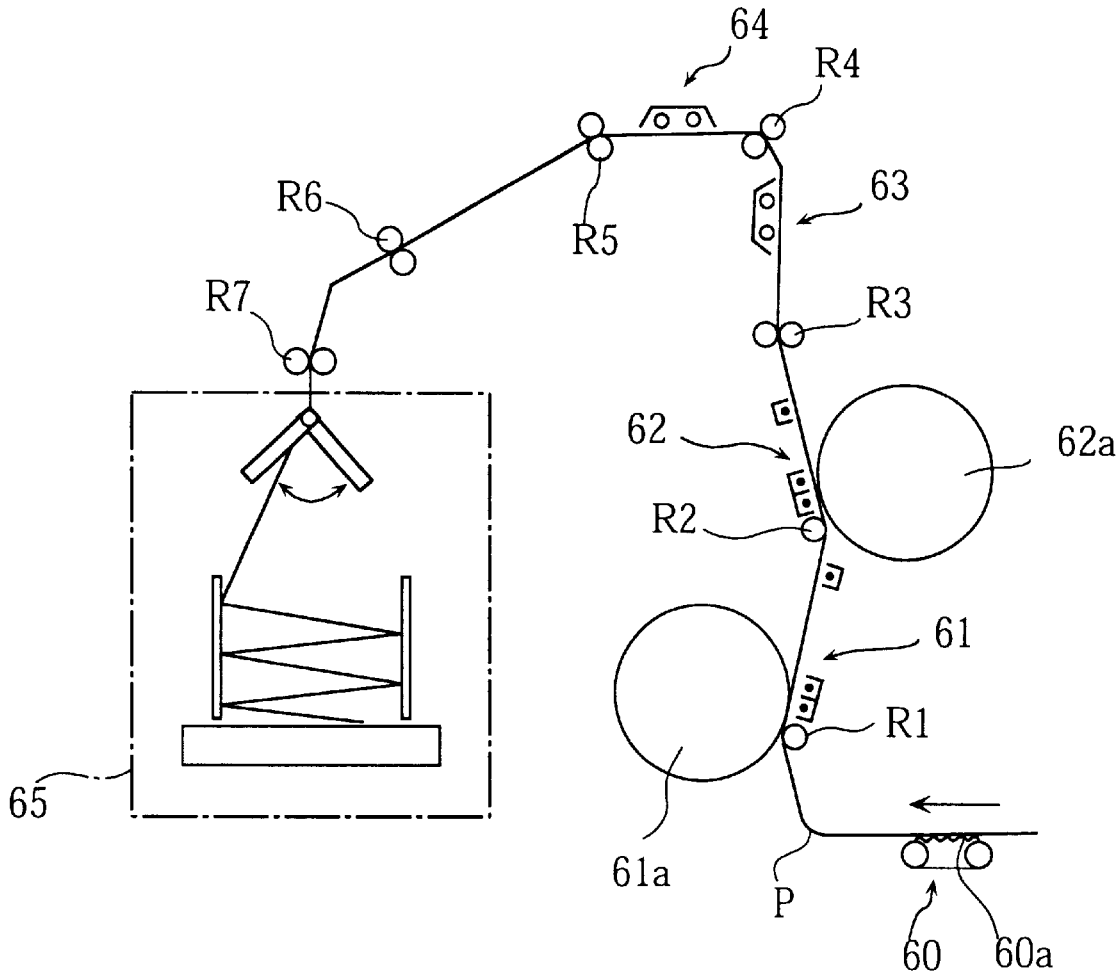
FIG. 1 schematically shows principal components of a printer incorporating a paper folding mechanism embodying the present invention.
Figure 11:
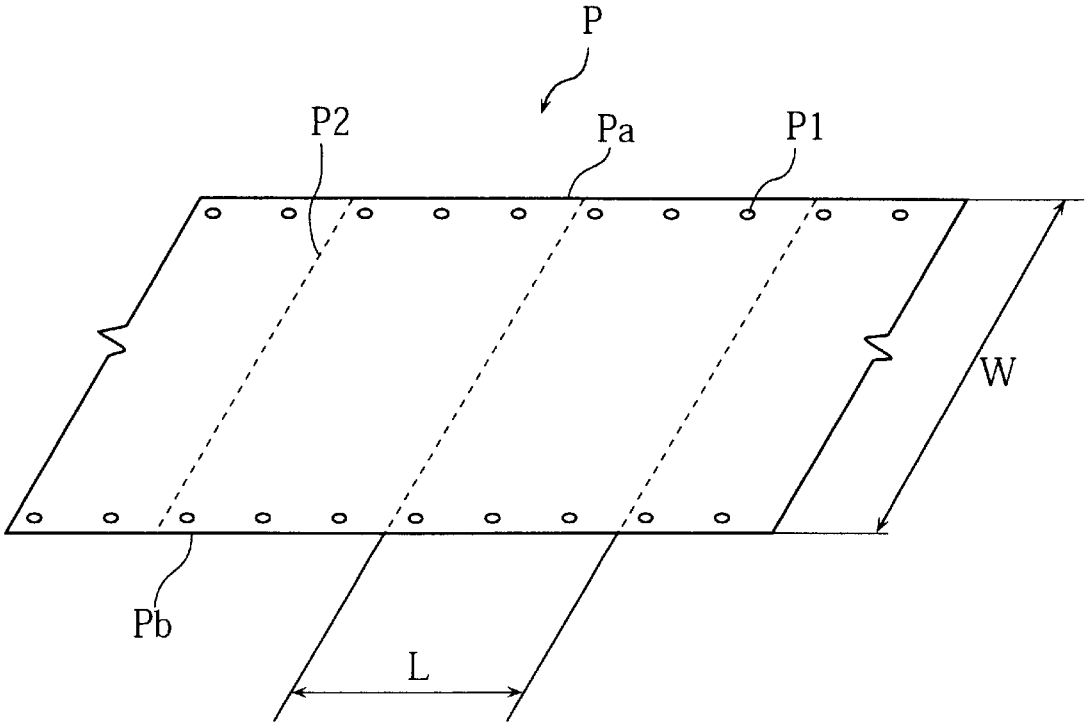
FIG.11 PRIOR ART
FIG. 11 shows an example of conventional continuous paper.
Figure 12:
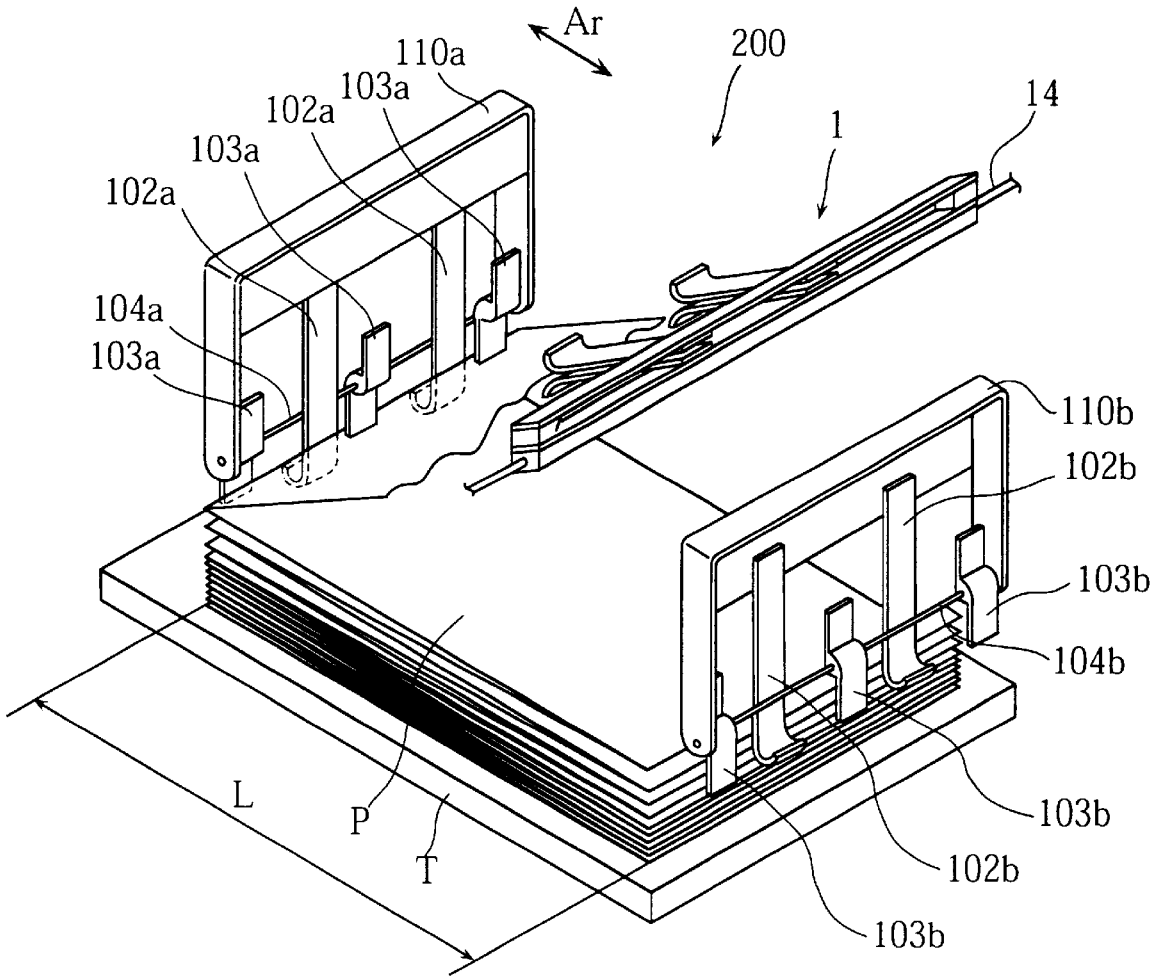
FIG.12 PRIOR ART
FIG. 12 is a perspective view showing a conventional paper folding mechanism.
Figure 13:
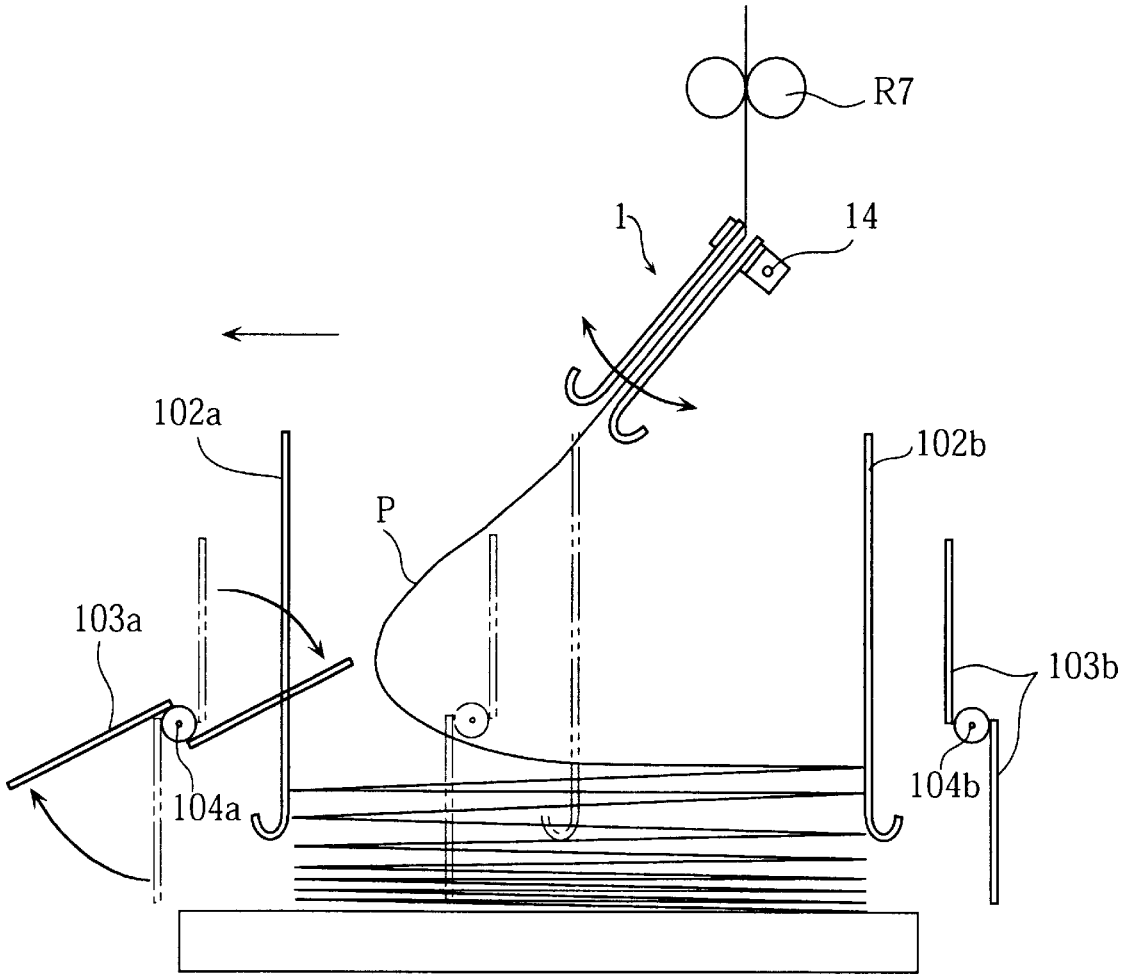
FIG.13 PRIOR ART
FIG. 13 illustrates a problem which may happen to the conventional folding mechanism.

FIG. 1 schematically shows the principal components a printer incorporating a paper folding mechanism embodying the present invention. The illustrated printer is designed to perform electrophotographic printing with respect to the obverse and reverse surfaces of continuous recording paper P. The paper P may be the same type of paper as shown in FIG. 11.

The illustrated printer includes a pair of tractors 60 (only one shown in FIG. 1) arranged at an upstream location of the paper transfer path. In operation, the tractors 60 serves to feed the paper P along the transfer path, while also functioning as a break to prevent the paper P from being moved too fast along the transfer path by other driving components arranged downstream from the tractors 60. Each of the tractors 60 is provided with a rotatable endless belt 60*a* which is formed with a plurality of protrusions coming into engagement with the indexing holes P1 (see FIG. 11) of the paper P. The rotational speed of the endless belts 60*a* is variable, so that the feeding rate of the paper P can be adjusted.

Further, the printer includes a first image transfer unit 61, a second image transfer unit 62, a first fixing unit 63 and a second fixing unit 64. The first image transfer unit 61 includes a first photosensitive drum 61*a* upon which toner-developed images are generated through the conventional latent image forming process and image developing process. The developed toner images are transferred onto the reverse surface of the paper P, and then thermally fixed to the paper by the first fixing unit 63. Similarly, the second image transfer unit 62 includes a second photosensitive drum 62*a* from which toner-developed images are transferred onto the obverse surface of the paper P. The transferred toner images are thermally fixed to the paper by the second fixing unit 64.

For properly advancing the paper P along the transfer path, the printer is provided with a number of guide or feed rollers R1–R6 arranged downstream from the tractors 60. In addition to these rollers, a pair of discharge rollers R7 is provided at the end of the transfer path. The printed paper P is discharged into a paper stacker 65 by the discharge rollers R7. As described below, the stacker 65 is provided with a paper folding mechanism for folding the discharged paper properly.

Figure 2:
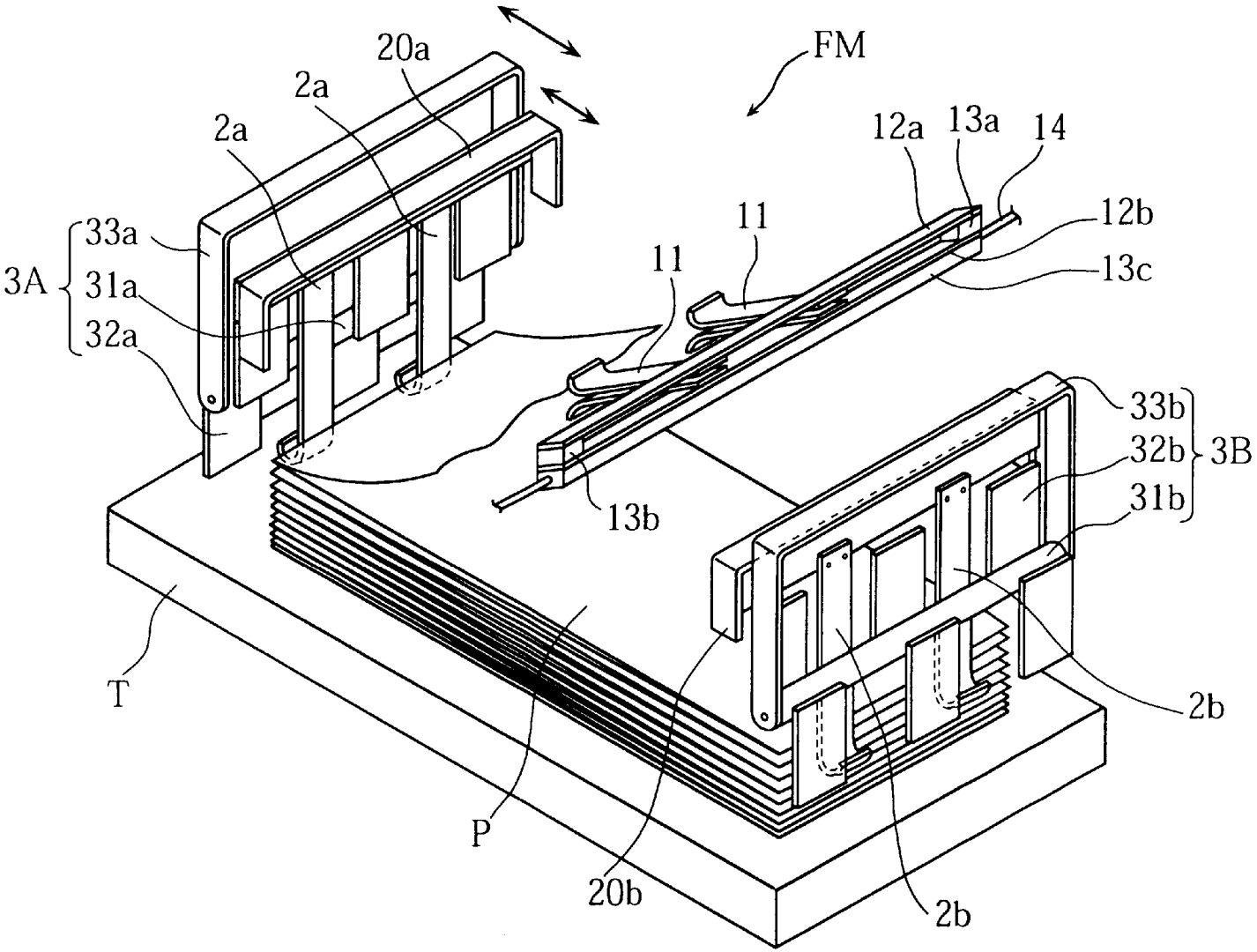
FIG. 2 is a perspective view showing the paper folding mechanism of the printer shown in FIG. 1.
Figure 3:
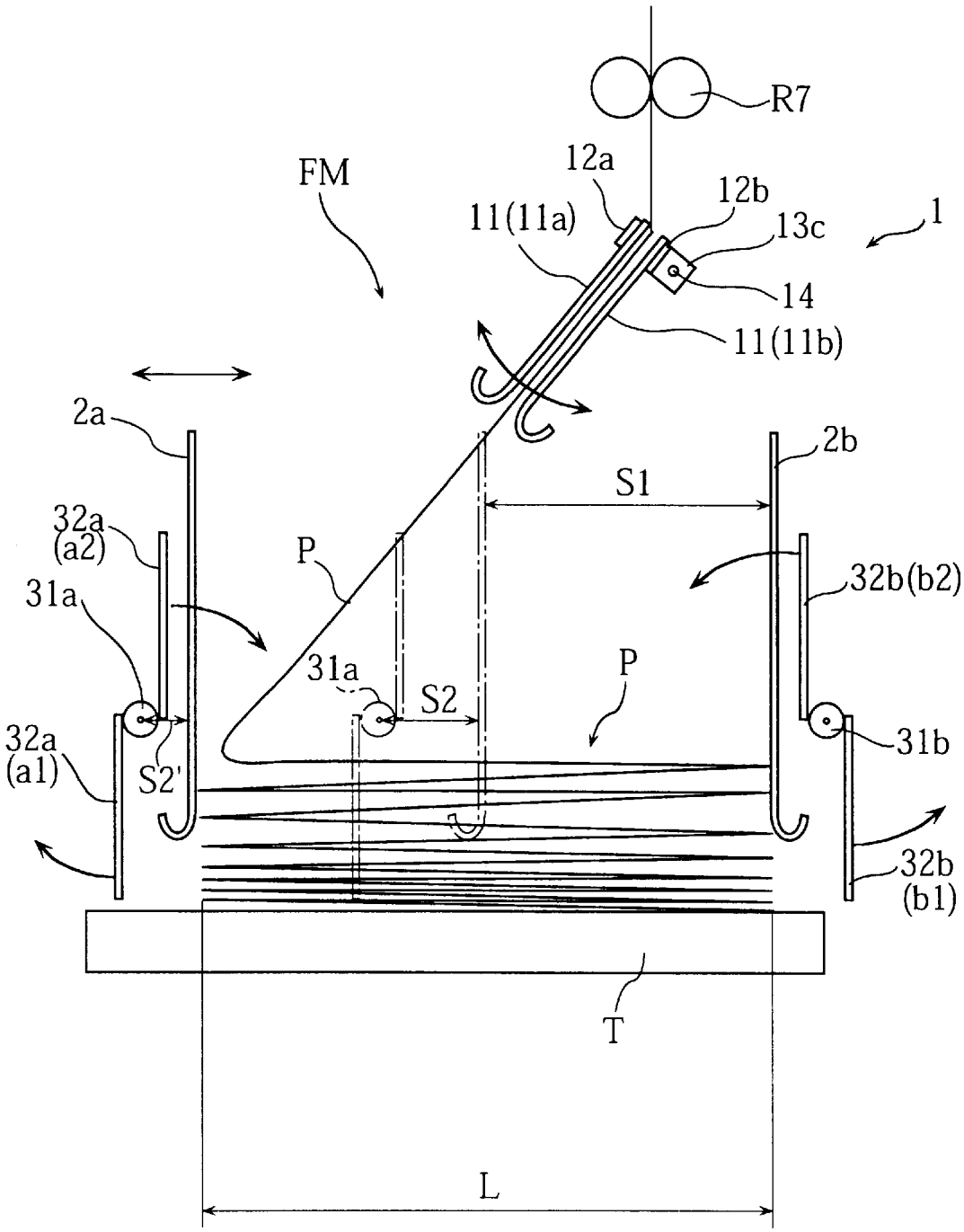
FIG. 3 is a schematic side view showing the paper folding mechanism of FIG. 2.

FIGS. 2 and 3 show principal components of a paper folding mechanism FM provided at the paper stacker 65. As illustrated, the paper folding mechanism FM is provided with a swing guide 1, a pair of upright first paper guides 2*a*, a pair of upright second paper guides 2*b*, a first paper presser 3A adjacent to the first paper guides 2*a*, a second paper presser 3B adjacent to the second paper guides 2*b*, and a vertically movable stacker table T.

In operation, as best shown in FIG. 3, the swing guide 1 is continuously paying out the paper P, while also being caused to swing on a driving shaft 14 in synchronism with the paper-feeding operation of the tractors 60 (FIG. 1). Thus, the paper P paid out from the swing guide 1 will be brought closer to the first paper guides 2*a* and the second paper guides 2*b*, alternately.

The swing guide 1 is made up of four J-shaped guide strips 11, a first elongated supporting plate 12*a* and a second elongated supporting plate 12*b* facing the first plate 12*a*. As shown in FIG. 2, two spacing blocks 13*a* and 13*b* come between the first and the second supporting plates 12*a*, 12*b*. The first block 13*a* is inserted between one ends of the first and the second plates 12*a* and 12*b*, while the second block 13*b* is inserted between the other ends of the two plates. In this manner, a predetermined clearance is provided between the first and the second plates 12*a* and 12*b* for allowing the passage of the discharged paper P.

The four guide strips 11 are grouped into two equal pairs each of which includes a first guide strip 11*a* and a second guide strip 11*b* (see FIG. 3). The first guide strip 11*a* is attached at its upper end to the first supporting plate 12*a*, while the second guide strip 11*b* is attached at its upper end to the second supporting plate 12*b*. The curved lower ends of the first and the second strips 11*a*, 11*b* are directed oppositely like the arms of an anchor.

As best shown in FIG. 3, the second supporting plate 12*b* is attached to a fixing member 13*c* which in turn is secured to the driving shaft 14. This shaft 14 is immovably fixed to the member 13*c*. The driving shaft 14 is rotatably attached to a non-illustrated supporting member of the paper folding mechanism FM. A selected end of the driving shaft 14 is connected to a motor (not shown), to move the swing guide 1 alternately toward the first paper guides 2*a* and the second paper guides 2*b*. The non-illustrated motor is driven in synchronism with the tractors 60 (FIG. 1), so that the swing motion of the swing guide 1 is performed in accordance with the feeding operation of the paper P.

The first and the second paper guides 2*a*, 2*b* serve to guide the folded paper P so that the paper will be neatly stacked up on the stacker table T. As best shown in FIG. 3, the paper guides 2*a*, 2*b* have a J-shaped configuration. The curved lower end of each paper guide 2*a* or 2*b* is directed away from the stacked paper P. The folded edges of the paper P stacked on the table T will come into contact with the upright straight portions of the paper guides 2*a* or 2*b*. As seen from FIG. 2, the first paper guides 2*a* are attached at their upper ends to a first guide frame 20*a*, while the second paper guides 2*b* are attached at their upper ends to a second guide frame 20*b*.

Though not illustrated, the first guide frame 20*a* is supported by two parallel rails via rollers. Thus, the first guide frame 20*a* can be moved manually toward or away from the stationary second guide frame 20*b*. Thus, it is possible to change the distance S1 (referred to as "guide distance" below) between the first paper guides 2*a* and the second paper guides 2*b*. To maintain the guide distance S1 once adjusted, a stopper (not shown) may be provided for holding the first guide frame 20*a* in the selected position.

According to the present invention, the positioning of the first paper guides 2*a* may be performed automatically. To this end, use may be made of a sensor for detecting the sheet length L of the paper P, and a driving means for sliding the first paper guides 2*a* relative to the second paper guides 2*b* based on a detection signal supplied from the sensor. The sheet length detection sensor may be arranged adjacent to the tractors 60.

As shown in FIGS. 2 and 3, the first paper presser 3A is made up of a first blade-supporting shaft 31*a*, six presser blades 32*a* and a first supporting frame 33*a*. The shaft 31*a* is rotatably attached to the frame 33*a*. The presser blades 32*a*, which are grouped into three pairs, are fixed to the shaft 31*a*. In each pair, as best shown in FIG. 3, one blade a1 and the other blade a2 are symmetrically disposed with respect to the axis of the shaft 31*a*. More specifically, the first blade al is attached at its upper end to a left-hand portion of the shaft 31*a* (a portion farther from the paper P), while the second blade a2 is attached at its lower end to a right-hand portion of the shaft 31*a* (a portion closer to the paper P). The first and the second blades a1, a2 are held in parallel to each other. A selected end of the shaft 31*a* is connected to a stepper motor. Thus, upon turning on the stepper motor, the shaft 31*a* will be rotated clockwise, as shown in FIG. 3, thereby causing the presser blades 32*a* to hit upon the paper P for folding this paper.

The second paper presser 3B is substantially an mirror image of the above-described first paper presser 3A. Specifically, the second paper presser 3B is made up of a second blade-supporting shaft 31*b*, six presser blades 32*b* and a second supporting frame 33*b*. The second shaft 31*b* is rotatably attached to the second frame 33*b*. The presser blades 32*b*, which are grouped into three pairs, are fixed to the second shaft 31*b*. In each pair, as best shown in FIG; 3, one blade b1 and the other blade b2 are symmetrically disposed with respect to the axis of the second shaft 31*b*. More specifically, the first blade b1 is attached at its upper end to a right-hand portion of the second shaft 31*b* (a portion farther from the paper P), while the second blade b2 is attached at its lower end to a left-hand portion of the second shaft 31*b* (a portion closer to the paper P). The first and the second blades b1, b2 are held in parallel to each other. A selected end of the second shaft 31*b* is connected to a stepper motor. Thus, when the stepper motor is turned on, the second shaft 31*b* is rotated counterclockwise, as shown in FIG. 3, thereby causing the presser blades 32*b* to hit upon the paper P and fold this.

When the sheet length L of the paper P is rendered greater or smaller (while supposing that the paper feeding rate is constant), the rotation speed of the shaft 31*a* may need to be changed accordingly, so that the first or second presser blades 32*a*, 32*b* can properly fold the paper P along the respective perforation lines P2.

Specifically, when the recording paper P has a greater sheet length L, it takes more time for a subsequent perforation line to come to a point adjacent to the first paper guides 2*a* after the previous perforation line came to the same point. In this case, the rotation speed of the shaft 31*a* will be made smaller, so that the first presser blades 32*a* can hit upon the best points on the paper P to properly fold the paper along the perforation lines. When the sheet length L is made smaller, on the other hand, the rotation speed of the shaft 31*a* will be made greater.

Preferably, the rotation speed of the shaft 31*a* may be automatically adjusted in accordance with the sheet length L of the paper P. To this end, use may be made of an automatic speed adjusting means designed to change the rotation speed of the shaft 31*a* based on a signal supplied from a sensor for detecting the variation of the guide distance S1.

As shown in FIG. 2, the first presser blades 32*a* are offset laterally (i.e. widthwise of the paper P) from the first paper guides 2*a* not to interfere with the paper guides 2*a*. Similarly, the second presser blades 32*b* are offset laterally from the second paper guides 2*b* for the same reason.

The first paper presser 3A is supported by two parallel rails (not shown) via rollers, so that the presser 3A is displaceable independently of the first paper guides 2*a*. Due to this, it is possible to change the distance S2 (FIG. 3) between the axis of the shaft 31*a* and the first paper guides 2*a*.

The second paper presser 3B, on the other hand, is fixed to a supporting member (not shown) of the paper folding mechanism FM. According to the present invention, however, the second paper presser 3B may also be displaceable as in the first paper presser 3A, so that the distance between the axis of the shaft 31*b* and the second paper guides 2*b* can be varied.

Next, the function of the paper folding mechanism FM will be described.

After discharged by the discharge rollers R7, the printed paper P is advanced through the clearance between the first guide strips 112*a* and the second guide strips 11*b* of the swing guide 1. While the paper P is being thus paid out, the swing guide 1 is caused to swing in synchronism with the operation of the tractors 60. Consequently, the paid-out portion of the continuous paper P will be warped in the vicinity of the first or second paper guides 20*a* or 20*b* (see FIG. 3). Then, the rotating presser blades 32*a* of the first paper presser 3A (or the rotating presser blades 32*b* of the second paper presser 3B) will hit upon the warped portion of the paper P and fold the paper along the perforation line P2. Finally, the folded paper is stacked up on the stacker table T, while being guided by the upright first and second paper guides 2*a*, 2*b*.

When the sheet length L of the paper P to be used is greater, the first paper guides 2*a* and the first paper presser 3A are moved farther away from the second paper guides 2*b*. In such an instance, as previously described regarding the prior art, the paper portion paid out from the swing guide 1 may be unduly warped with a relatively large radius of curvature near the first guides 2*a*. According to the present invention, such warped paper P can be properly folded for the following reason.

Specifically, the first paper presser 3A is horizontally movable relative to the first paper guides 2*a*, as stated above. Thus, when the paper P is warped with a large radius of curvature near the guides 2*a*, the paper presser 3A will be brought closer to the paper guides 2*a* to narrow the distance S2, as shown in FIG. 3 (where the distance S2' is smaller than the distance S2) As a result, the rotary blades 32*a* of the paper presser 3A are moved closer to the warped portion of the paper P, so that the blades 32*a* can fold the paper P properly along the perforation line P2.

It is worth mentioning that the present invention is helpful even in an instance where the warping of the paper P is not so large. Generally, there is an optimum point on continuous paper to be hit by the presser blades 32*a* for properly folding the paper along its perforation lines. The location of this optimum point (or points) depends upon the sheet length L of the paper. Specifically, the optimum point will be spaced further away from the first paper guides 2*a* as the sheet length L of the paper is rendered greater. Conversely, the optimum point will come closer to the first guides 2*a* when the sheet length L is small. According to the present invention, it is possible to cause the blades 32*a* of the presser 3A to hit upon the optimum point of the paper by adjusting the distance S2.

In the above-described embodiment, the distance S2 is adjusted by manually shifting the first paper presser 3A relative to the first paper guides 2*a*. Alternatively, the adjustment of the distance S2 may be performed automatically in accordance with the variation of the guide distance S1. To this end, use may be made of a paper presser shifting mechanism as described below.

Figure 4:
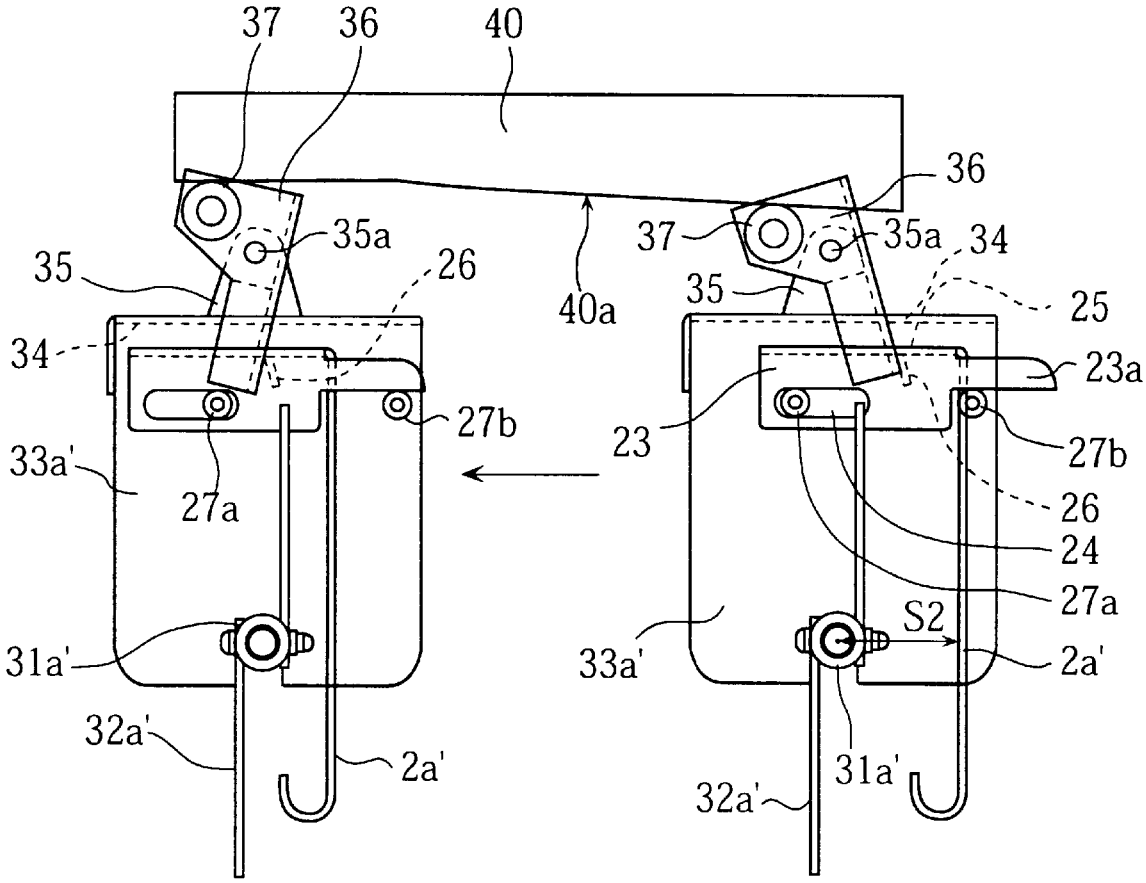
FIG. 4 is a side view showing a paper presser shifting mechanism advantageously used with the paper folding mechanism.

Specifically, referring to FIG. 4, the paper presser shifting mechanism includes two generally rectangular side plates 33*a*' (only one shown in the figure) spaced from each other widthwise of the paper P. The upper portions of the respective side plates 33*a*' are attached to an elongated bridging plate 34 extending widthwise of the paper P. Each side plate 33*a*' rotatably supports, at its lower portion, one end of a blade-supporting shaft 31*a*' as shown in FIGS. 2 and 3. Six presser blades 32*a*' are attached to the shaft 31*a*' in the same manner as shown in FIGS. 2 and 3.

The paper presser shifting mechanism also includes two parallel guide rails 40 which are arranged above the side plates 33*a*', respectively. The bridging plate 34 is supported by these rails 40 via non-illustrated rollers, so that the plate 34 is movable in the longitudinal directions of the rails 40.

As shown in FIG. 4, a generally rectangular, lever supporting plate 35 is attached to the bridging plate 34 above each side plate 33*a*'. A generally L-shaped lever 36 is attached to the lever supporting plate 35, so that the lever 36 is pivotable about a pin 35*a*. A roller 37 is rotatably attached to an upper portion of the lever 36. The lever 36 is urged clockwise, so that the roller 37 will be constantly held in contact with the inclined lower edge 40*a* of the rail 40. The lower portion of the lever 36 extends downward through a slit (not shown) formed in the bridging plate 34.

Two J-shaped, first paper guides 2*a*', like the ones shown in FIGS. 2 and 3, are spaced from each other widthwise of the paper P and attached to a horizontal, paper guide supporting plate 25 extending widthwise of the paper. The horizontal plate 25 is formed with a pair of lever insertion openings (not shown) spaced widthwise of the paper P for allowing the passage of the downwardly extending levers 36. As shown in FIG. 4, a tongue 26, protruding downward from the lower surface of the plate 25, is disposed adjacent to each lever insertion opening. The plate 25 is urged to the left so that the tongue 26 is held in constant pressing engagement with the lower portion of the lever 36.

Two vertical guide plates 23 each are fixed to a respective one of the two ends of the plate 25. As shown in FIG. 4, each guide plate 23 is formed with a horizontally elongated opening 24. Further, the guide plate 23 is provided with a horizontal protrusion 23*a* extending to the right. A horizontal supporting shaft 27*a* is slidably fitted into the opening 24, while another supporting shaft 27*b* is slidably engaged with the lower edge of the protrusion 23*a*. These supporting shafts 27*a*, 27*b* are connected, at their both ends, to the side plates 33*a*'. With such an arrangement, the horizontal plate 25 and the guide plates 23 attached to the plate 25 are horizontally movable relative to the side plates 33*a*', (hence to the shaft 31*a*' attached to the side plates 33*a*') This means that the distance S2 between the first paper guides 2*a*' and the axis of the shaft 31*a*' is variable.

The function of the above-described paper presser shifting mechanism is as follows. When the side plates 33*a*' are moved, manually or automatically, from the right position to the left position shown in FIG. 4, the lever 36 is caused to pivot clockwise about the pin 35*a* since the lower edge 40*a* of the rail 40 ascends to the left. Thus, the horizontal plate 25, which is held in constant engagement with the lower end of the lever 36 via the tongue 26, will be moved to the left relative to the side plates 33*a*'. Consequently, the paper guides 2*a*' are brought closer to the shaft 31*a*'.

Figure 5:
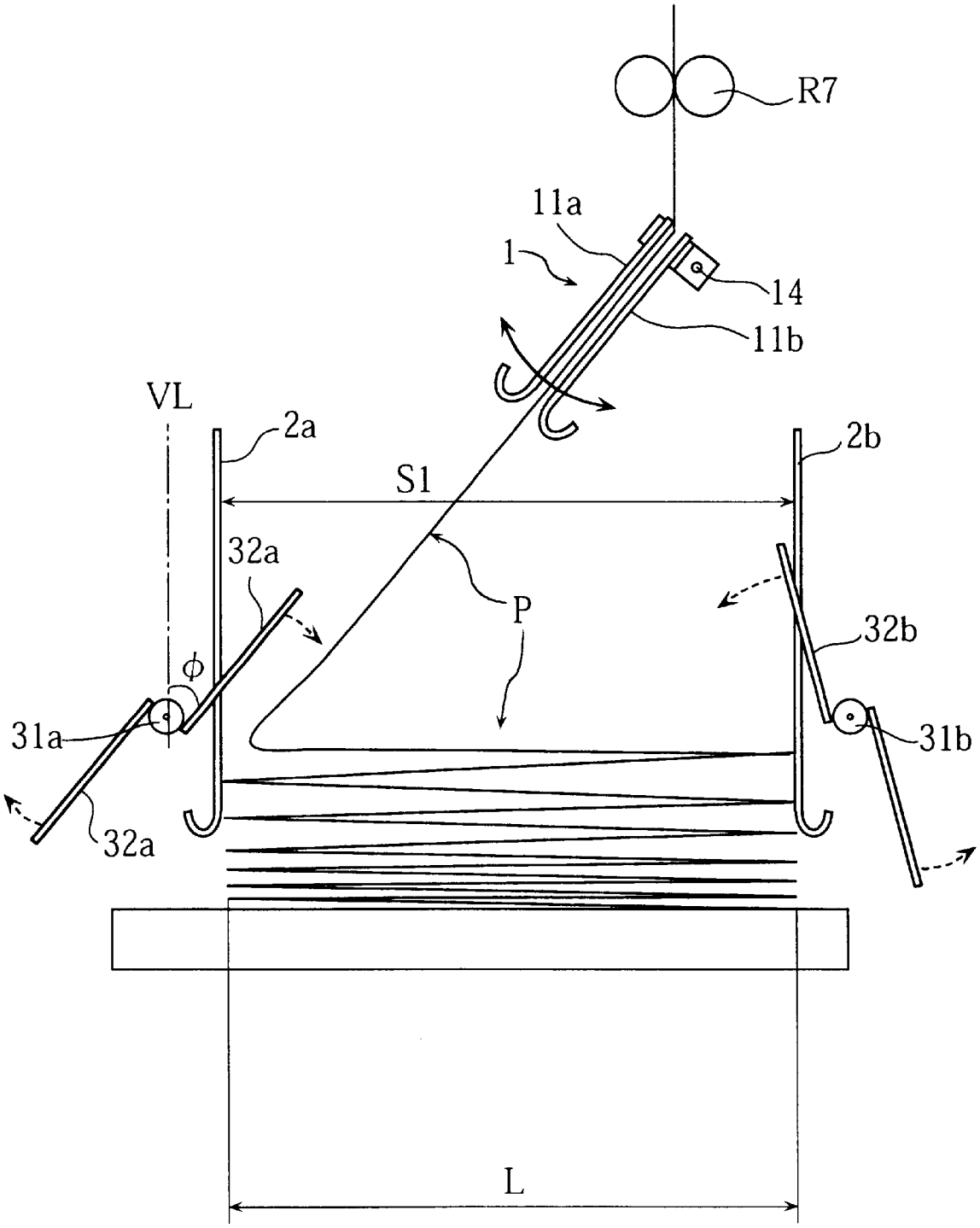
FIG. 5 illustrates a possible way to operate the paper presser blades of the paper folding mechanism.
Figure 6:
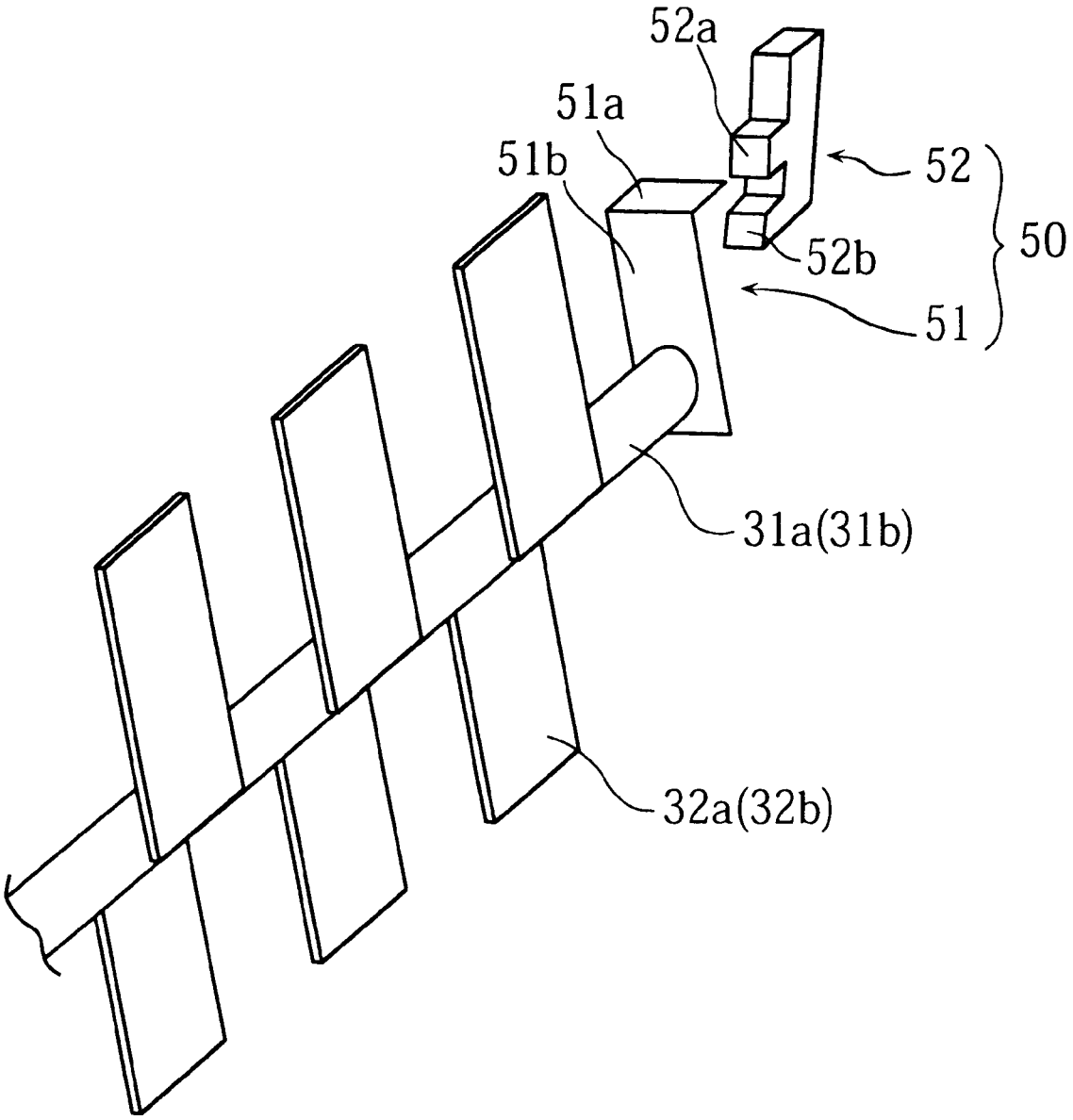
FIG. 6 shows an optical sensor and a light shielding member cooperating with the sensor for halting the presser blades in a home position.

Reference is now made to FIGS. 5 and 6 illustrating a possible way to operate the presser blades 32*a* and 32*b* of the paper folding mechanism of the present invention. Specifically, the first and second presser blades 32*a*, 32*b* may be halted in the predetermined "home position", as shown in FIG. 5, before these blades hit the discharged paper P. In the home position, the presser blades responsible for immediate hitting operation (in FIG. 5, the right-hand one of the two blades 32*a*) take a non-upright posture, in which the presser blades are inclined at a predetermined angle $\phi$ with respect to the vertical line VL toward the paper P. In the illustrated embodiment, the presser blade 32*a* extends substantially in parallel to the paper portion paid out from the swing guide 1. Then, with proper timing, the rotation of the presser blades is resumed for folding the paper P.

In the above manner, the "home position" presser blades 2*a* overhang the discharged portion of the paper P, thereby preventing the paper P from being unduly warped. Thus, the paper P will be properly folded by the presser blades 2*a*.

It is possible to temporarily stop the presser blades 2*a* or 2*b* at the home position in the following manner. Specifically, referring to FIG. 6, use may be made of a home position detector 50 designed to detect the positions of the presser blades 32*a* (32*b*) rotated on the shaft 31*a* (31*b*). The illustrated detector 50 includes an L-shaped light shielding plate (home position detection plate) 51 and an optical sensor 52. The light shielding plate 51 is provided with a relatively short leg portion 51*a* and a relatively long portion 51*b* attached to one end of the shaft 31*a* (31*b*). The optical sensor 52 is provided with a light emitting portion 52*a* and a light receiving portion 52*b*. These two portions 52*a*, 52*b* protrude sideways from the main body of the sensor 52, while being vertically spaced from each other.

In operation, detection light is emitted downward from the light emitting portion 52*a*, to be received by the light receiving portion 52*b*. When the shaft 31*a* is rotated, the leg portion 51*a* of the light shielding plate 51 will come between the vertically spaced portions 52*a* and 52*b* of the optical sensor 52, to shield the detection light. Upon this, it is determined that the presser blades 32*a* have been brought to the home position, and the motor connected to the shaft 31*a* is stopped immediately. Thereafter, the rotation of the presser blades 32*a* will be resumed for folding the warped portion of the paper P. To restart the operation of the motor with proper timing, the detector 50 may be provided with a timer (not shown) to monitor the lapse of time after the presser blades 32*a* come to the home position. When the timer indicates that a preset period of time has passed, the rotation of the shaft 31*a* will be resumed. The preset time may be determined in accordance with the period of the pivotal movement of the swing guide 1.

Figure 7:
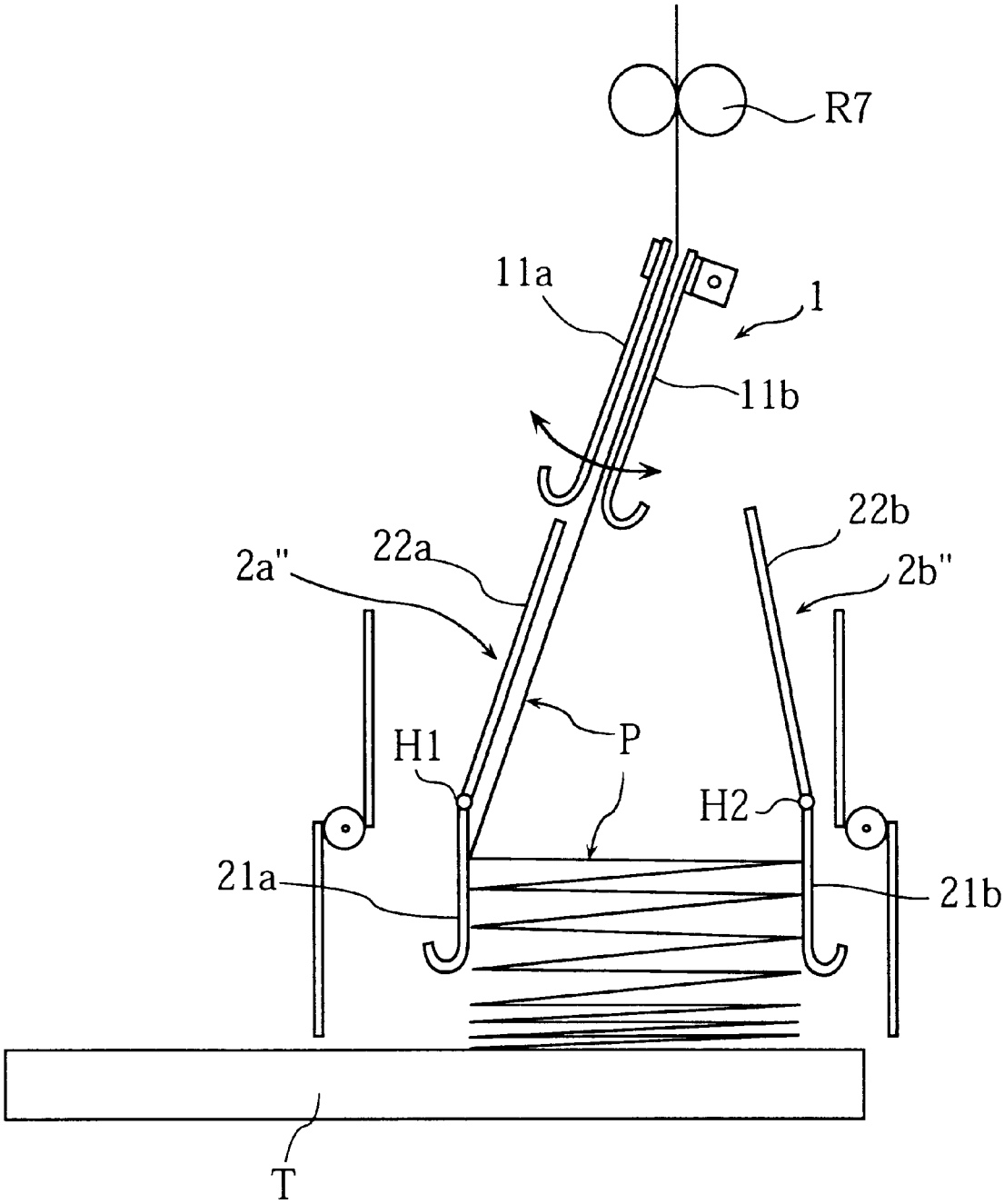
FIGS. 7 and 8 illustrate the function of modified paper guide plates used for the paper folding mechanism.
Figure 8:
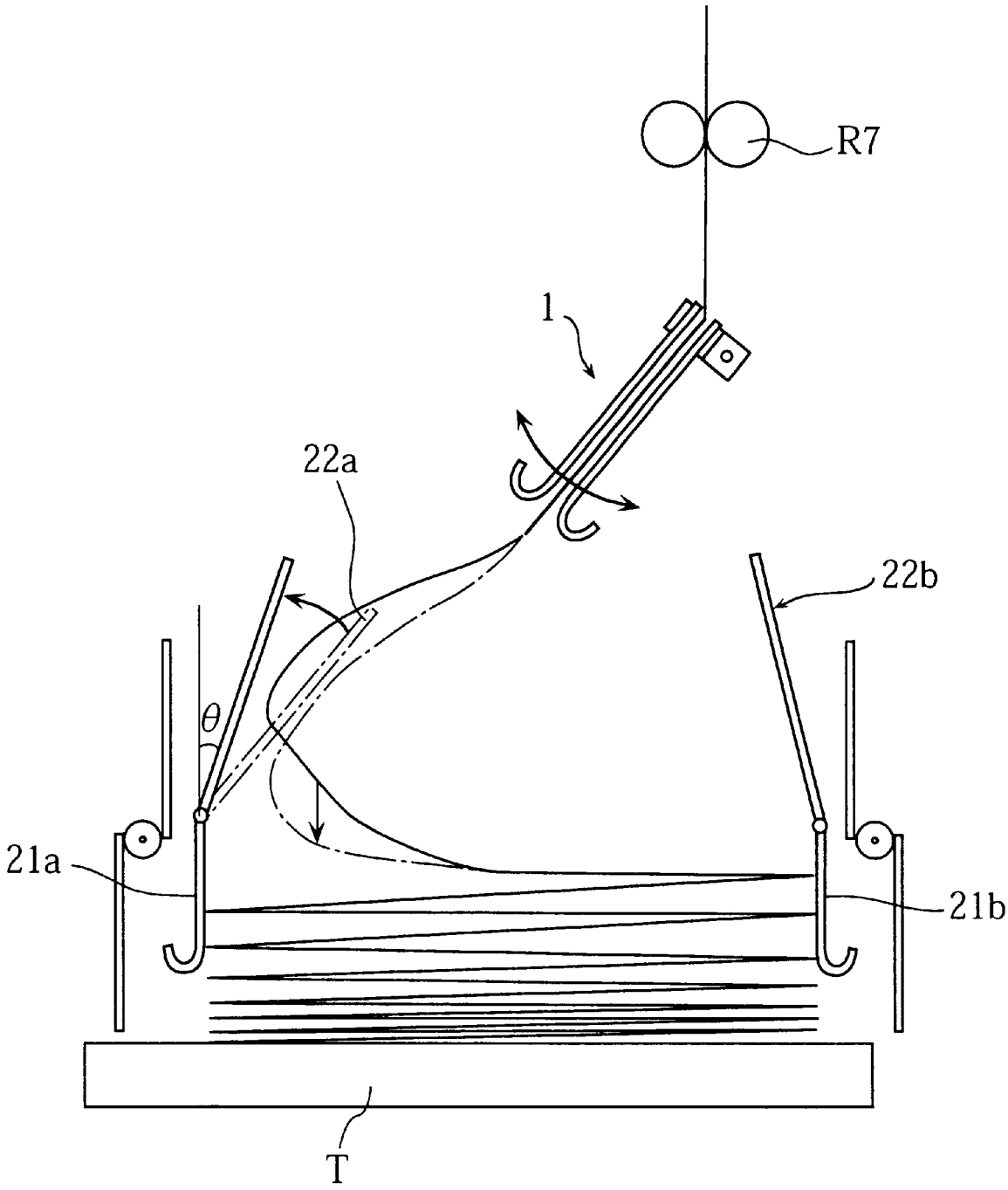

Reference is now made to FIGS. 7 and 8 which illustrate a modification made to the first and the second paper guides 2*a*, 2*b* shown in FIGS. 2 and 3. In the illustrated embodiment, the first and the second paper guides 2*a*", 2*b*" can be bent at their hinged portion H1 or H2. Each first paper guide 2*a*" includes a J-shaped lower portion 21*a* and a straight upper portion 22*a* which is connected to the lower portion 21*a* via the hinged portion H1. Similarly, each second paper guide 2*b*" includes a J-shaped lower portion 21*b* and a straight upper portion 22*b* which is connected to the lower portion 21*b* via the hinged portion H2. As shown in FIG. 7, the lower portions 21*a* and 21*b* are held in an upright position, while the upper portions 22*a* and 22*b* may be inclined inward (i.e., toward each other) by the hinged portions H1 and H2, respectively. As shown in FIG. 8, the inclination angle $\theta$ of the upper portions 22*a*, 22*b* with respect to the vertical line may be rendered smaller as the sheet length of the paper P becomes greater. Preferably, the adjustment of the inclination angle may be performed automatically in accordance with the sheet length of the paper to be used.

Figure 9:
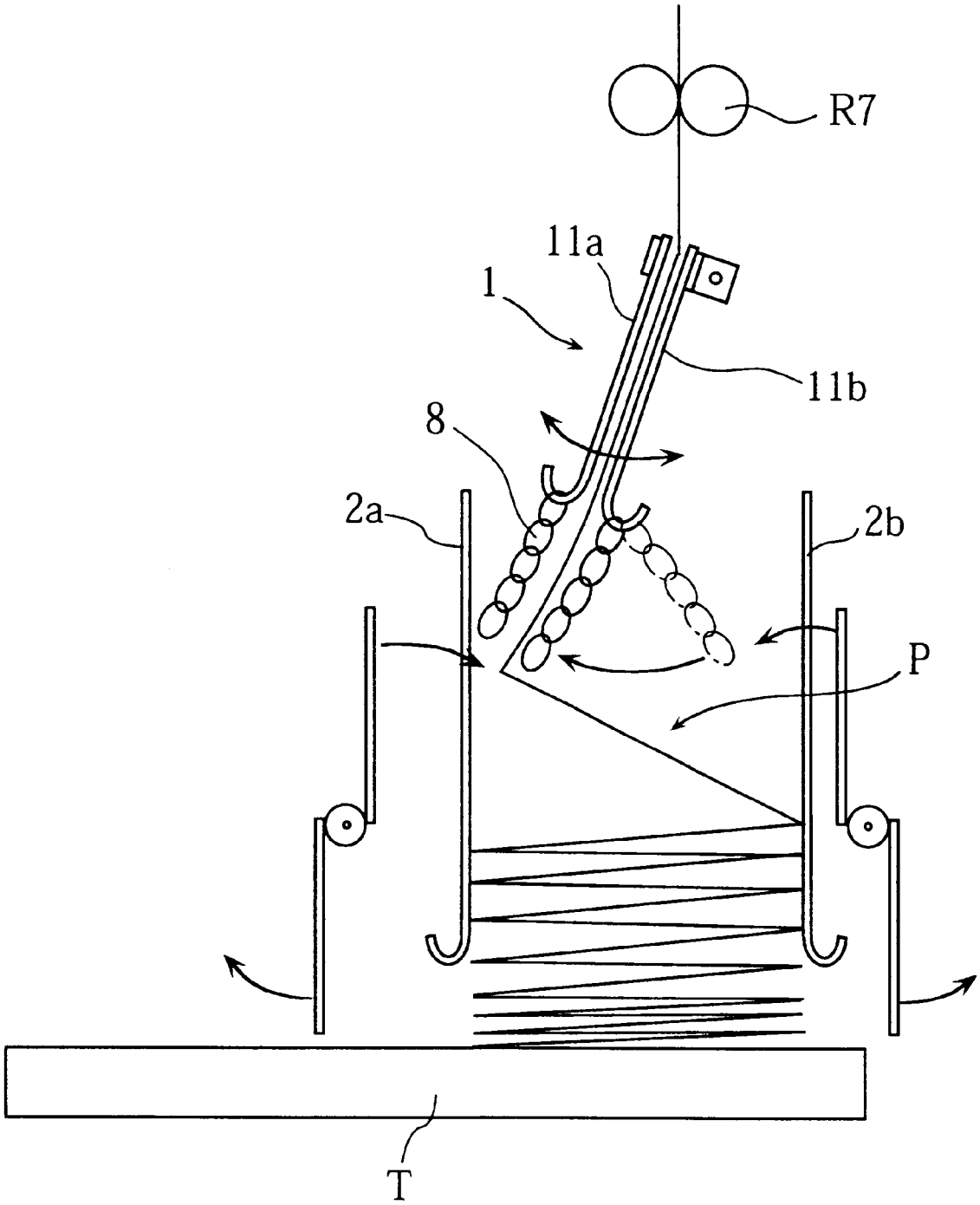
FIG. 9 illustrates the function of a paper-folding assist member attached to the swing guide of the paper folding mechanism.
Figure 14:
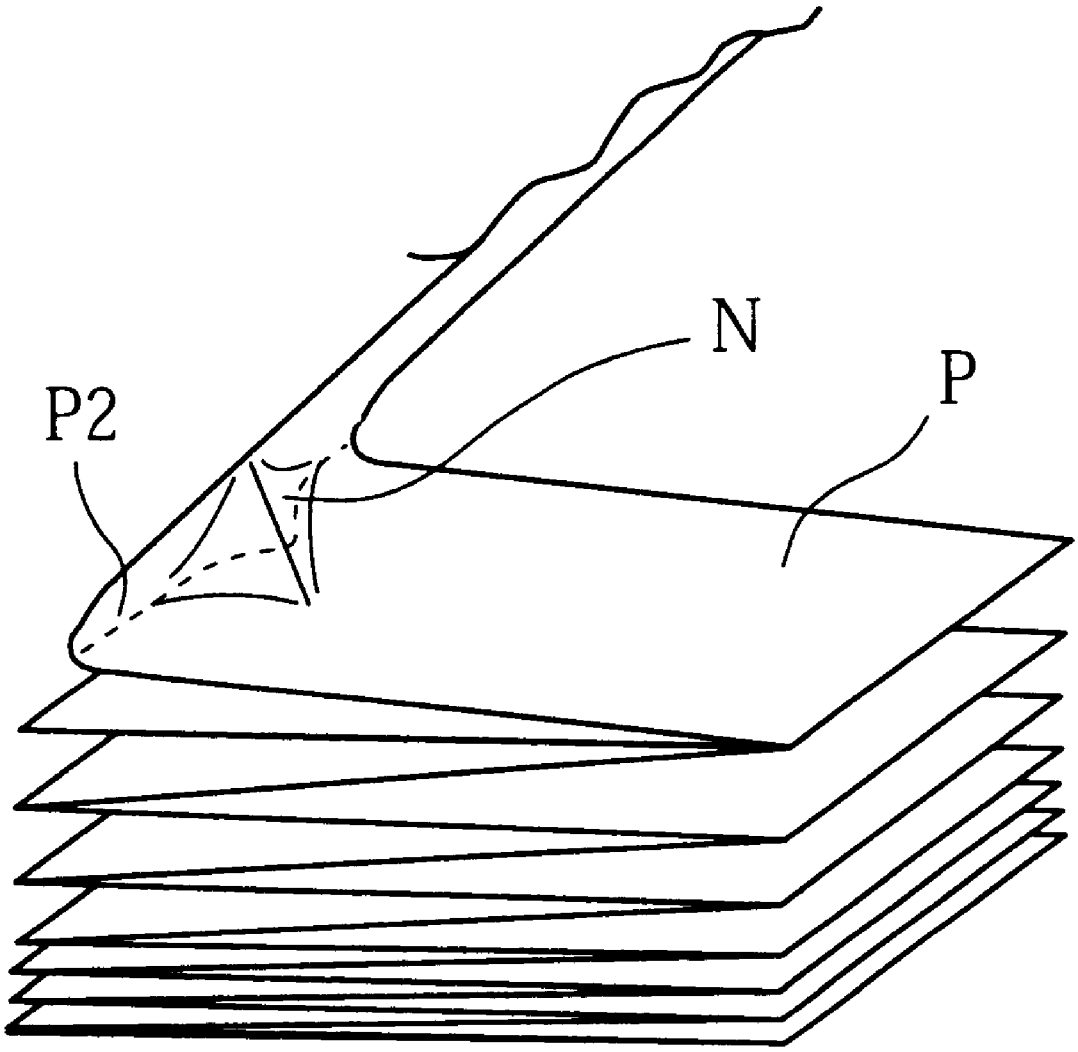
FIG.14 PRIOR ART
FIG. 14 shows continuous paper in which a wrinkle is generated at a perforation line.

According to the present invention, as shown in FIG. 9, use may be made of pendulums 8 for facilitating the folding of the paper P. In the illustrated example, a chain is attached at its upper end to the curved lower end of each paper guide strip 11*a* or 11*b*, so that the chain is caused to swing together with the pivoting of the swing guide 1. Each chain has a predetermined length suitable for hitting the paper P in the vicinity of a perforation line along which the paper P is about to be folded. The use of such paper-folding assist members is helpful especially when there is a solid printing portion extending across a perforation line of the paper P. Without taking any countermeasures, the paper with such a solid printing portion may fail to be folded properly, as previously described with reference to FIG. 14 (Prior Art) With the use of the pendulums 8, however, the problem can be eliminated or at least mitigated to a satisfactory extent. As readily understood, the length, weight, configuration, etc. of each pendulum 8 may be varied depending upon e.g. the sheet length or thickness of the paper P, or upon the conditions of the solid printing portion.

Figure 10A:
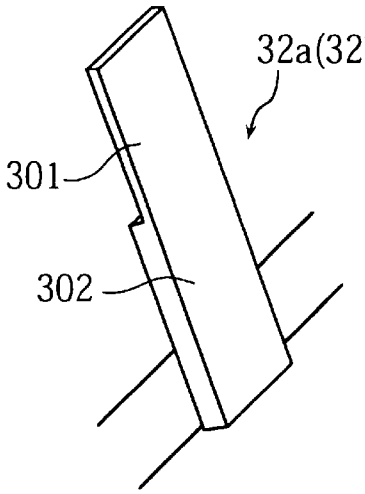
FIGS. 10A, 10B and 10C show examples of paper presser blade used for the paper folding mechanism.
Figure 10B:
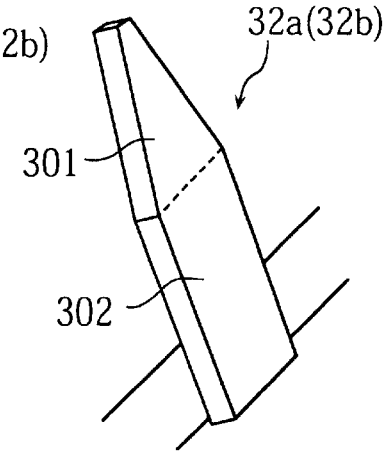
Figure 10C:
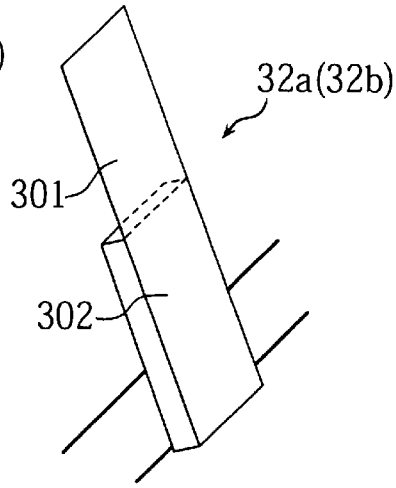

Referring to FIGS. 10A–10C, according to the present invention, each of the paper presser blades 32*a* and 32*b* may be rendered more flexible in its free end portion 301 than in its base end portion 302. Specifically, in the presser blade of FIG. 10A, the free end portion 301 is made smaller in thickness than the base end portion 302. In the presser blade of FIG. 10B, the width of the free end portion 301 is made smaller as proceeding further away from the rectangular base portion 302. In the presser blade of FIG. 10C, a flexible film (free end portion 301) is attached to a rectangular base member (base end portion 302). Advantageously, the illustrated presser blades 32*a* or 32*b* are less liable to tear the paper P, due to their flexible free end portion.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

What is claimed is:

1. A paper folding mechanism for continuous paper provided with fold lines spaced by a constant sheet length, the mechanism comprising:

a swing guide caused to pivot for guiding the paper;

a first and a second paper guide spaced from each other by a guide distance corresponding to the sheet length, the first paper guide being displaceable relative to the second paper guide;

a paper presser arranged adjacent to the first paper guide for folding the paper along the fold lines, the paper presser being displaceable relative to the first paper guide; and paper presser shifting means for displacing the paper presser relative to the first paper guide in accordance with displacement of the first paper guide.

2. The paper folding mechanism according to claim 1, wherein the paper presser includes a presser blade and a rotatable shaft to fix the presser blade, the shaft being displaceable relative to the first paper guide.

3. The paper folding mechanism according to claim 2, wherein the presser blade includes a free end portion and a base end portion fixed to the rotatable shaft, the free end portion being more flexible than the base end portion.

4. The paper folding mechanism according to claim 2, wherein the paper presser shifting means includes a side plate for rotatably fixing the shaft, a lever pivotable relative to the side plate, a guide rail with which the lever is held in slidable contact, and a paper guide supporting member to which the first paper guide is attached, the paper guide supporting member being engaged with the lever and displaceable relative to the side plate.

5. The paper folding mechanism according to claim 4, wherein the guide rail is provided with an inclined edge, the lever being provided with a roller urged into contact with the inclined edge of the guide rail.

6. The paper folding mechanism according to claim 2, further comprising presser blade halting means for retaining the presser blade in a home position before the presser blade hits the paper.

7. The paper folding mechanism according to claim 6, wherein the presser blade in the home position is inclined toward the paper beyond the first paper guide.

8. The paper folding mechanism according to claim 6, wherein the presser blade halting means includes a sensor for detecting a rotational position of the shaft.

9. The paper folding mechanism according to claim 8, wherein the presser blade halting means further includes a home position detection plate attached to an end of the shaft.

10. The paper folding mechanism according to claim 9, wherein the sensor is provided with a light emitting portion and a light receiving portion spaced from the light emitting portion, the home position detection plate being brought into a clearance between the light emitting portion and the light receiving portion when the shaft is rotated.

11. The paper folding mechanism according to claim 1, wherein the paper presser shifting means causes the paper presser to approach the first paper guide as the guide distance becomes greater.

12. The paper folding mechanism according to claim 1, wherein each of the paper guides is provided with an inclined upper portion and an upright lower portion, the upper portion being inclined to extend along the paper to be folded.

13. The paper folding mechanism according to claim 12, wherein the inclined upper portion is connected to the upright lower portion by a hinged portion permitting adjustment of an angle between the upper portion and the lower portion.

14. The paper folding mechanism according to claim 1, further comprising auxiliary paper folding means attached to the swing guide.

15. The paper folding mechanism according to claim 14, wherein the auxiliary paper folding means comprises a chain dangling from the swing guide.

16. A paper folding mechanism for continuous paper provided with fold lines spaced by a constant sheet length, the mechanism comprising:

a swing guide caused to pivot for guiding the paper;

a first and a second paper guide spaced from each other by a guide distance corresponding to the sheet length, the first paper guide being displaceable relative to the second paper guide;

a paper presser arranged adjacent to the first paper guide for folding the paper along the fold lines, the paper presser including a presser blade and a rotatable shaft to fix the presser blade, the shaft being displaceable relative to the first paper guide; and presser blade halting means for retaining the presser blade in a home position before the presser blade hits the paper.

17. The paper folding mechanism according to claim 16, wherein the presser blade in the home position is inclined toward the paper beyond the first paper guide.

18. The paper folding mechanism according to claim 16, wherein the presser blade halting means includes a sensor for detecting a rotational position of the shaft.

19. The paper folding mechanism according to claim 18, wherein the presser blade halting means further includes a home position detection plate attached to an end of the shaft.

20. The paper folding mechanism according to claim 19, wherein the sensor is provided with a light emitting portion and a light receiving portion spaced from the light emitting portion, the home position detection plate being brought into a clearance between the light emitting portion and the light receiving portion when the shaft is rotated.

* * * * *